US006199236B1

(12) United States Patent
Mullins

(10) Patent No.: US 6,199,236 B1
(45) Date of Patent: Mar. 13, 2001

(54) VEHICLE SERVICE RAMP

(76) Inventor: Clarence D. Mullins, 1202 N. 11th St., Orange City, KS (US) 66523

( * ) Notice: Subject to any disclaimer, the term of this patent is extended or adjusted under 35 U.S.C. 154(b) by 0 days.

(21) Appl. No.: 09/290,125

(22) Filed: Apr. 12, 1999

(51) Int. Cl.[7] ..... E01D 1/00
(52) U.S. Cl. ..... 14/69.5; 254/88
(58) Field of Search ..... 14/69.5; D32/34; 254/88

(56) References Cited

U.S. PATENT DOCUMENTS

| | | | | |
|---|---|---|---|---|
| D. 347,502 | * | 5/1994 | Mazza | D34/32 |
| 1,452,188 | * | 4/1923 | Christ | 254/88 |
| 1,922,552 | * | 8/1933 | McCosh | 254/88 |
| 3,752,441 | * | 8/1973 | Rogers | 254/88 |
| 3,863,895 | | 2/1975 | Grewe et al. | 254/88 |
| 4,050,403 | * | 9/1977 | Miller | 116/124 R |
| 4,194,724 | * | 3/1980 | Masegian | 254/88 |
| 4,341,371 | | 7/1982 | Rotella . | |
| 4,610,440 | * | 9/1986 | Casset | 269/20 |
| 4,920,597 | | 5/1990 | Hamilton . | |
| 5,033,146 | | 7/1991 | Fogarty et al. . | |
| 5,221,380 | * | 6/1993 | Wilson et al. | 254/88 |
| 5,269,036 | | 12/1993 | Yan et al. | 14/69.5 |
| 5,279,346 | * | 1/1994 | Summey | 152/213 R |
| 5,324,004 | * | 6/1994 | Richardson | 254/88 |
| 5,400,846 | | 3/1995 | Bowman . | |
| 5,483,715 | * | 1/1996 | Fogarty et al. | 14/69.5 |

* cited by examiner

*Primary Examiner*—Thomas B. Will
*Assistant Examiner*—Kristine M. Markovich
(74) *Attorney, Agent, or Firm*—Kenneth L Tolar

(57) ABSTRACT

A vehicle service ramp including a ramp member having an inclined rear wall and a horizontal top wall. A slot extends along the rear wall and the top wall through which an arcuate chocking member protrudes slightly. The chocking member pivots as a vehicle tire ascends the rear wall and engages the front or rear ends of the chocking member. A rotatable shaft is mounted within the ramp member and includes a bent portion for engaging a fork on the chocking member allowing a user to manually pivot the chocking member. The shaft further includes a locking device for locking the chocking member about a vehicle's tire. An alarm also alerts a user whenever the chocking member pivots such as when the vehicle is descending or ascending the ramp member.

8 Claims, 3 Drawing Sheets

VEHICLE SERVICE RAMP

BACKGROUND OF THE INVENTION

The present invention relates to a vehicle service ramp having an automated chocking device that prevents the vehicle wheel from shifting or rolling off the ramp.

DESCRIPTION OF THE PRIOR ART

Mechanics often use service ramps to elevate the front or rear end of a vehicle. However, when the vehicle's wheel is resting on the ramp, the wheel can easily shift or roll off resulting in serious bodily injury to those nearby or beneath the vehicle. Accordingly, there is currently a need for a service ramp that includes a means for preventing the vehicle wheel from shifting or rolling. There is also a need for alerting those nearby should the wheel begin shifting or rolling affording them an opportunity to evacuate the area. The present invention satisfies such needs by providing a vehicle service ramp having an automated chocking means to prevent the tire from inadvertently rolling off the ramp. In addition, the ramp includes an alarm for alerting those nearby that the vehicle wheel is moving.

Various service ramps for vehicles exist in the prior art. Most notably is U.S. Pat. No. 5,269,036 issued to Yan et al. which relates to a vehicular ramp including a support surface having forward and rear abutment plates for abutting opposing sides of a vehicle tire. The front abutment plate, when contacted by a vehicle wheel, engages an actuator mechanism that automatically pivots the rear plate upwardly. The mechanism, however, includes a complicated and difficult to manufacture actuator mechanism for pivoting the plates as well as a cumbersome locking means for locking the plates in a vertical position. Furthermore, the device does not include any alarms for alerting those in the vicinity that the vehicle wheel is moving onto or off of the ramp.

SUMMARY OF THE INVENTION

The present invention relates to a vehicle service ramp that overcomes the disadvantages associated with conventional service ramps as described above. The device comprises a hollow ramp member having opposing side walls, an inclined rear wall, and a horizontal top wall. A chock member is pivotably mounted within the interior of the ramp member and includes front and rear upturned ends. A slot extends along the front and top walls through which the upturned ends of the chock member protrude slightly when the chock member is in a substantially horizontal position so that the ends abut opposing portions of a vehicle tire. A shaft is rotably mounted within the ramp member interior and includes a bent portion that engages a fork on the chock member to pivot the chock member back and forth. When the chock member is in the horizontal position, it may be locked to prevent a vehicle tire from rolling off the ramp member. The ramp member further includes an internal alarm means that is activated whenever the chock member pivots to alert those in the vicinity that the vehicle is moving. It is therefore an object of the present invention to provide a vehicle service ramp having an automated chocking means thereon.

It is another object of the present invention to provide a vehicle service ramp having an integral alarm means for alerting persons nearby that the vehicle wheel is moving.

It is yet another object of the present invention to provide a vehicle service ramp having an automated chocking device that may be selectively locked in a raised position. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
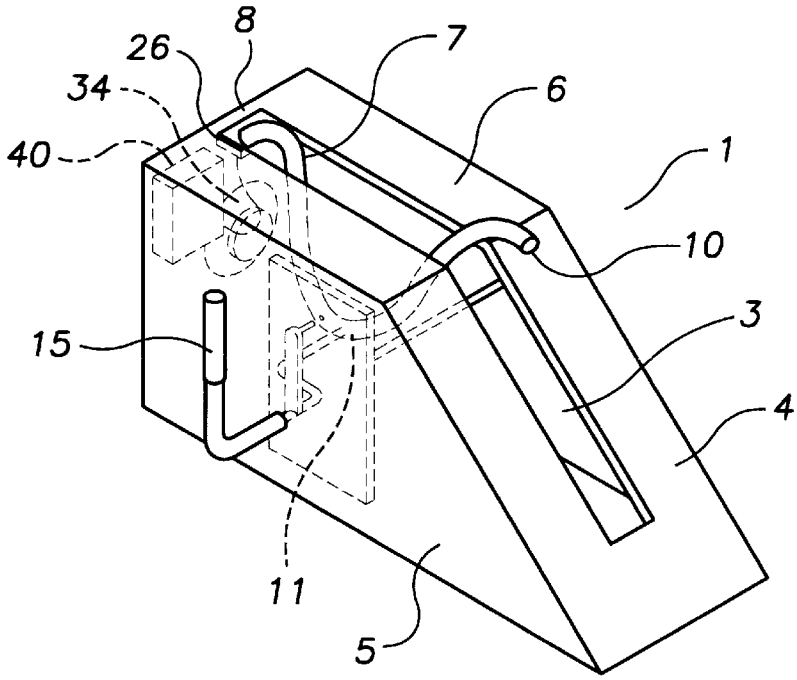
FIG. 1 is a perspective view of the inventive device with the internal components depicted in phantom.
Figure 2:
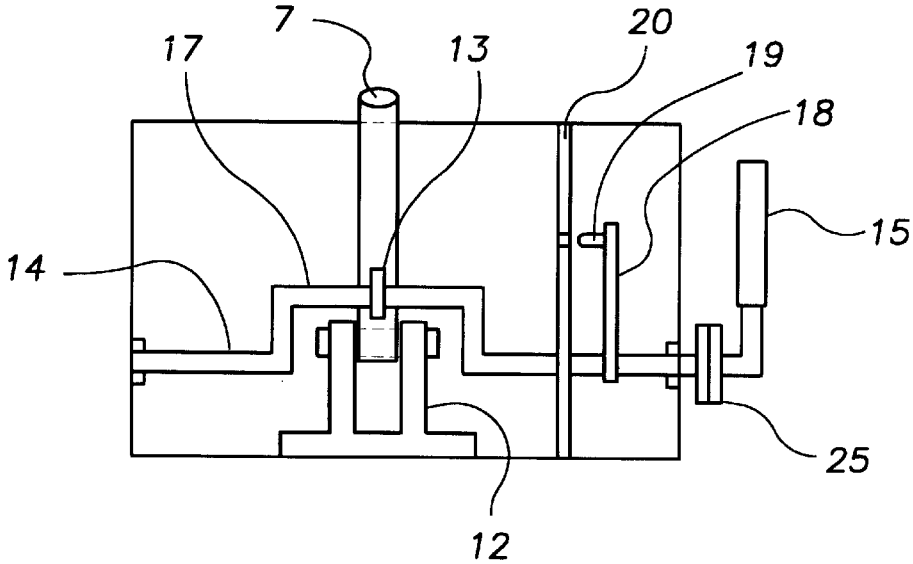
FIG. 2 is an end view of the device depicting the internal components.
Figure 3:
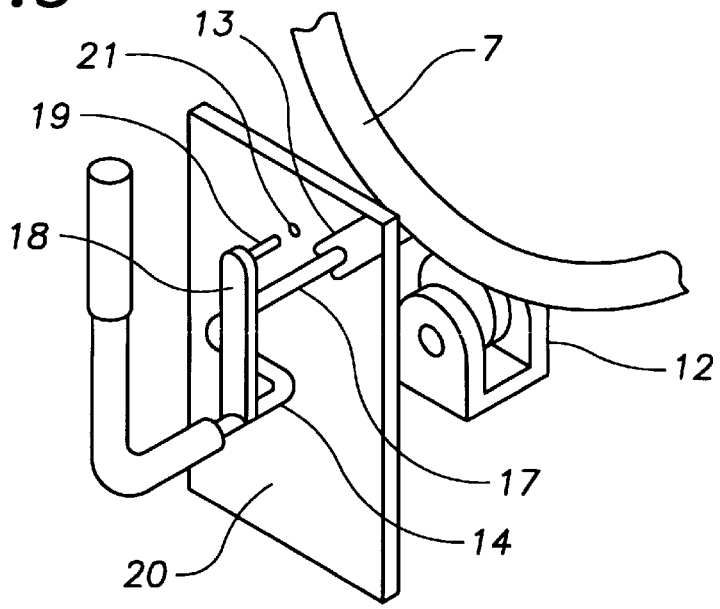
FIG. 3 is a detailed perspective view of the shaft locking mechanism.

Referring now to FIGS. 1 through 5, the present invention relates to vehicle service ramp. The device comprises a ramp member 1 having an inclined rear wall 4, a pair of opposing side walls 5 and a planar horizontal top wall 6. A slot 3 extends from the rear wall to the front end of the top wall and is in communication with an interior chamber.

Figure 5:
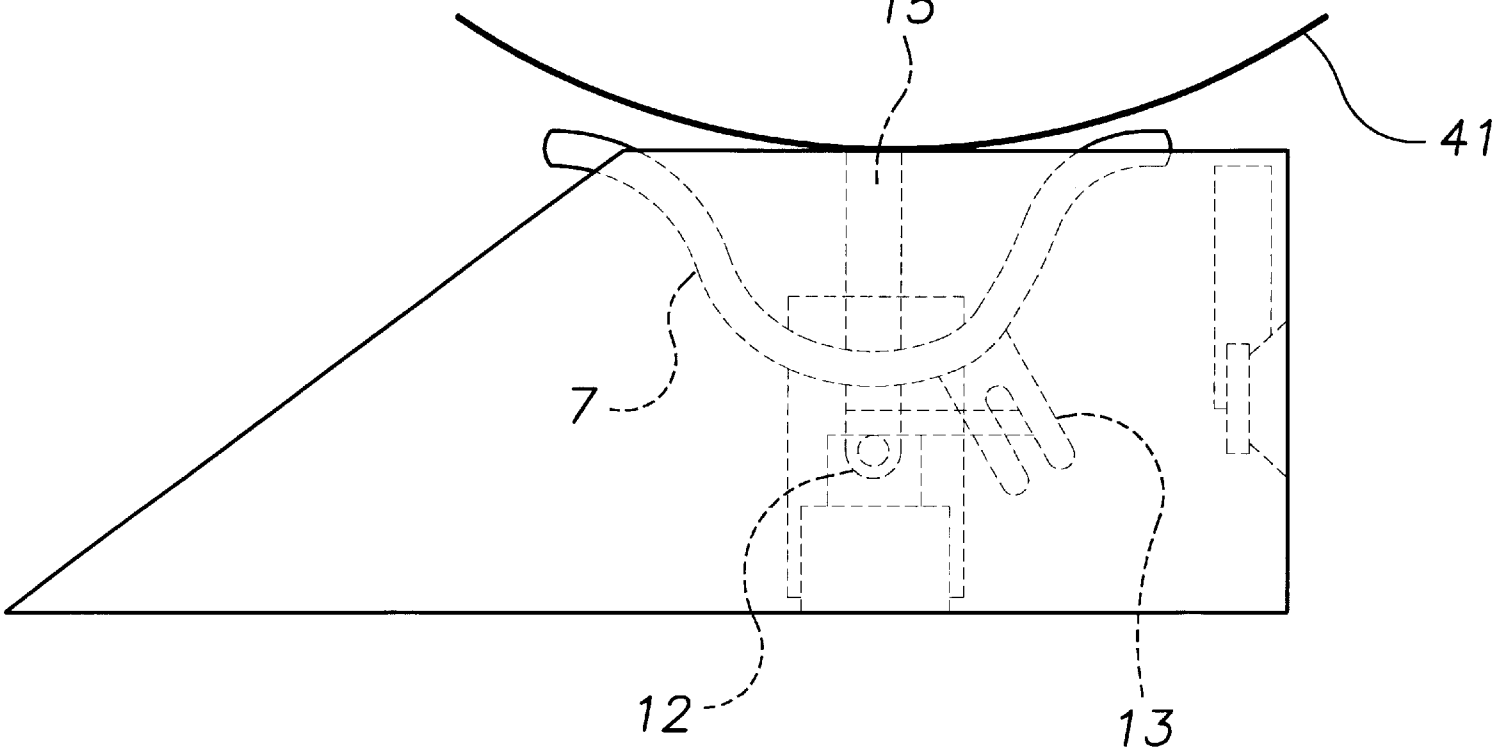
FIG. 5 is a side view of the ramp member with the chock member in a substantially horizontal position with the front and rear ends abutting opposing portions of the tire.

An arcuate chock member 7 is mounted within the ramp member interior chamber. The chock member includes an upturned front end 8, an upturned rear end 10 and a lower portion 11 therebetween. The lower portion is pivotally joined to a U-shaped bracket 12 mounted within the ramp member interior chamber allowing the chock member to pivot back and forth. When the chock member is substantially horizontal, both the front and rear ends of the chocking member protrude slightly from the slot as depicted in FIG. 5 to abut opposing portions of the lower section of a tire 41.

Extending outwardly from the lower portion of the chock member is a fork 13 that, in cooperation with a shaft 14, manually pivots the chock member back and forth. The shaft 14 is rotatably mounted within the ramp member interior chamber. A first end of the shaft extends from a side wall of the ramp member and has a handle 15 attached thereto which may be grasped by a user to rotate the shaft. The shaft is movable inwardly and outwardly relative to the ramp member. The shaft includes a bent portion 17 that cooperatively engages the fork when the shaft is rotated to move the chock member. Fixedly mounted to the shaft is a plate 18 with a pin 19 protruding therefrom. The shaft rotates within a locking panel 20 having an aperture thereon 21 positioned to receive the pin. When the shaft is moved inwardly and rotated to the proper position, the pin seats within the aperture thereby preventing the shaft and thus the chock member from rotating.

As an option, the handle portion may be coupled with the shaft using a safety clutch 25 mechanism designed to slip upon the application of a predetermined amount of angular resistance to the handle, such as if the handle engages a fixed object. The clutch minimizes injury to a person whose limb may be inadvertently pinned by the handle while the vehicle is rolling up or down the ramp.

Figure 4:
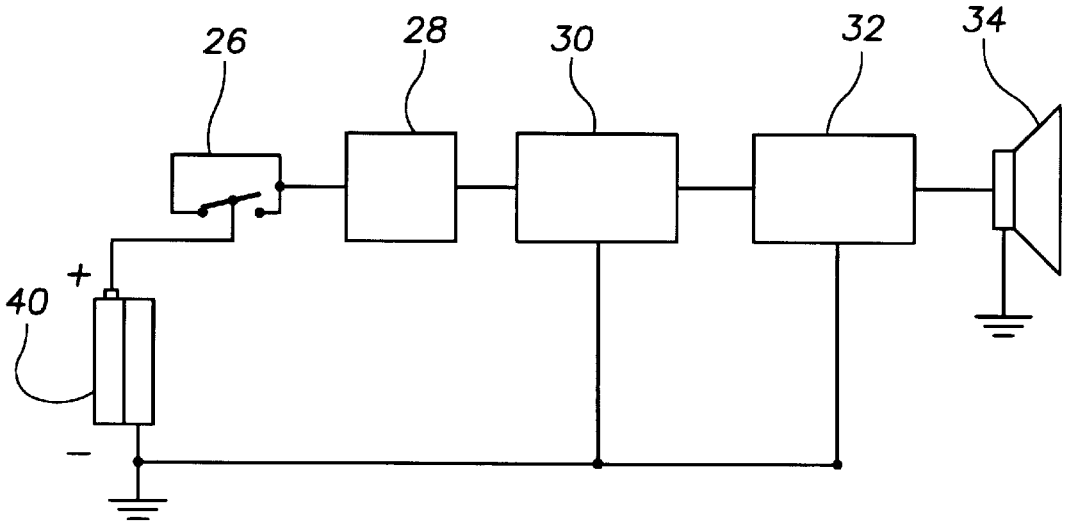
FIG. 4 is a schematic of the alarm means according to the present invention.

A switch means 26 is disposed immediately below the front end of the chock member. The switch means is a DPDT switch that activates an alarm means whenever the front end of the chock member engages the switch means or is removed therefrom. Referring now to FIG. 4, a schematic of the alarm means is depicted. The switch means 26 is in communication with a 555 timer 28, an oscillator 30, an audio amplifier 32 and speaker 34. Once the alarm is activated, the timer deactivates the alarm after a predetermined delay. The timer resets each time voltage is applied thereto. Accordingly, an alarm is emitted each time a vehicle wheel rolls onto or off of the top wall of the ramp member. The alarm means is powered with a battery 40.

To use the above described device, the handle is rotated toward the inclined rear wall to pivot the rear end of the chocking member into the ramp member interior chamber. A vehicle tire is driven up the inclined rear wall on the ramp member until it reaches the top wall. Upon the tire engaging the front end of the chock member, the rear end pivots upwardly whereby the chock member pivots to a substantially horizontal position and the front and rear ends abut opposing portions of the vehicle tire. At such time, the alarm means is activated alerting persons nearby that a vehicle wheel has moved onto the ramp. The shaft is rotated until the handle is in a vertical position at which time the bent portion of the shaft is received within the fork. The shaft is then slid inwardly toward the ramp member until the pin seats within the aperture on the locking panel thereby preventing movement of the chocking member. When removing the vehicle, the shaft is moved to the outward position and the vehicle is driven off the ramp at which time the alarm is reactivated.

The various components described above may be manufactured with a variety of suitable components. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A vehicle service ramp comprising:

a ramp member including a hollow interior, a horizontal top wall, a pair of opposing side walls and an inclined rear wall depending therefrom, said ramp member further including a slot extending along the top and rear walls;

an arcuate chock member having upwardly extending front and rear ends, with a lower portion therebetween, the lower portion pivotally mounted within the interior of the ramp member whereby the front and rear ends may be pivoted to barely protrude through the slot;

a fork extending from the lower portion of the chocking member;

a shaft rotatably mounted within the hollow interior of the ramp member, said shaft having a bent portion for selectively engaging the fork to pivot said chocking member.

2. The vehicle service ramp according to claim 1 further comprising an alarm means for alerting a user whenever said chock member is pivoted.

3. A vehicle service ramp comprising:

a ramp member having a hollow interior, a pair of opposing vertical side walls, a horizontal top wall and an inclined rear wall;

an alarm means for alerting a user when a vehicle tire is moving on said top wall;

an arcuate chocking member having front and rear ends with a low portion therebetween, said lower portion pivotally secured within the interior of said ramp member, the front and rear ends of said chocking member pivotable within a slot extending along the front and top walls of said ramp member whereby as said vehicle tire ascends the inclined rear wall, the tire engages the rear end of said chocking member, pivoting the front end upwardly, said front end pivoting downwardly upon engagement by said vehicle tire thereby causing the chocking member to assume a substantially horizontal position whereby the front and rear ends of said chocking member abut opposing portions of the vehicle tire.

4. The vehicle service ramp according to claim 3 further comprising a locking means for locking said chocking member in the substantially horizontal position.

5. The vehicle service ramp according to claim 4 wherein said locking means comprises:

a shaft selectively engaging said chocking member, said shaft movable between an inward and outward position, said shaft including a plate mounted thereon with a protrusion extending from said plate;

a locking panel fixedly mounted within the interior of said ramp member, said panel including an aperture thereon for receiving said protrusion when said shaft is placed in the inward position to prevent rotation of said shaft and thus movement of said chocking member.

6. The vehicle service ramp according to claim 5 further comprising a handle member attached to an end of said shaft which may be grasped by a user to rotate said shaft.

7. The vehicle service ramp according to claim 6 wherein said handle member is attached to said shaft with a clutch mechanism whereby said handle rotates independently of said shaft upon application of a predetermined amount of angular resistance to said handle.

8. The vehicle service ramp according to claim 3 wherein said alarm means comprises a switch means disposed immediately beneath and activated by the front end of said chocking member;

an alarm circuit in communication with said switch means that emits an audible alarm upon said switch means being activated.

* * * * *